United States Patent [19]

Szerdahelyi

[11] Patent Number: 4,899,492

[45] Date of Patent: Feb. 13, 1990

[54] SYSTEM FOR WINDOW OPERATION, ESPECIALLY IN A MOTOR VEHICLE

[75] Inventor: Ferenc Szerdahelyi, Coburg, Fed. Rep. of Germany

[73] Assignee: Brose Fahrzeugteile GmbH & Co. Kommanditgesellschaft, Coburg, Fed. Rep. of Germany

[21] Appl. No.: 249,350

[22] Filed: Sep. 23, 1988

[30] Foreign Application Priority Data

Sep. 25, 1987 [DE] Fed. Rep. of Germany ..... 3732431

[51] Int. Cl.[4] ..... E05F 11/48

[52] U.S. Cl. ..... 49/352; 49/349; 49/360

[58] Field of Search ..... 49/352, 349, 362, 360

[56] References Cited

U.S. PATENT DOCUMENTS

| | | | |
|---|---|---|---|
| 1,640,459 | 8/1927 | Lee | 49/352 |
| 1,770,087 | 7/1930 | Quick et al. | 49/352 X |
| 1,916,579 | 7/1933 | Mosher | 49/352 |
| 1,997,646 | 4/1935 | Miller | 49/352 X |
| 3,022,064 | 2/1962 | Russell | 49/352 X |
| 3,706,163 | 12/1972 | Pickles | 49/362 |
| 4,216,624 | 8/1980 | Blankenburg et al. | 49/352 |
| 4,534,233 | 8/1985 | Hamaguchi | 49/352 X |
| 4,628,759 | 12/1986 | Kobayashi et al. | 49/352 X |
| 4,648,206 | 3/1987 | Moriya et al. | 49/352 |

FOREIGN PATENT DOCUMENTS

| | | |
|---|---|---|
| 3000050 | 7/1981 | Fed. Rep. of Germany . |
| 8218814 | 10/1982 | Fed. Rep. of Germany . |
| 3136890 | 4/1983 | Fed. Rep. of Germany . |
| 8616770 | 9/1986 | Fed. Rep. of Germany . |

*Primary Examiner*—Philip C. Kannan

*Attorney, Agent, or Firm*—Toren, McGeady & Associates

[57] ABSTRACT

A window actuating system, especially in a motor vehicle, including a guide rail, an entrainment device for a window glass plate supported at the guide rail, a force transmission member engaging at the entrainment device, a drive member for the force transmission member attached to the guide rail and selectably with a manual drive unit arranged to be remote from the guide rail or a motorized drive unit coupled with the drive member, the drive member being provided with a reverse brake, especially a wrap around spring brake, and the motorized drive unit being attached directly at the drive member or at the drive rail in the region of the drive member.

16 Claims, 2 Drawing Sheets

Figure 7:
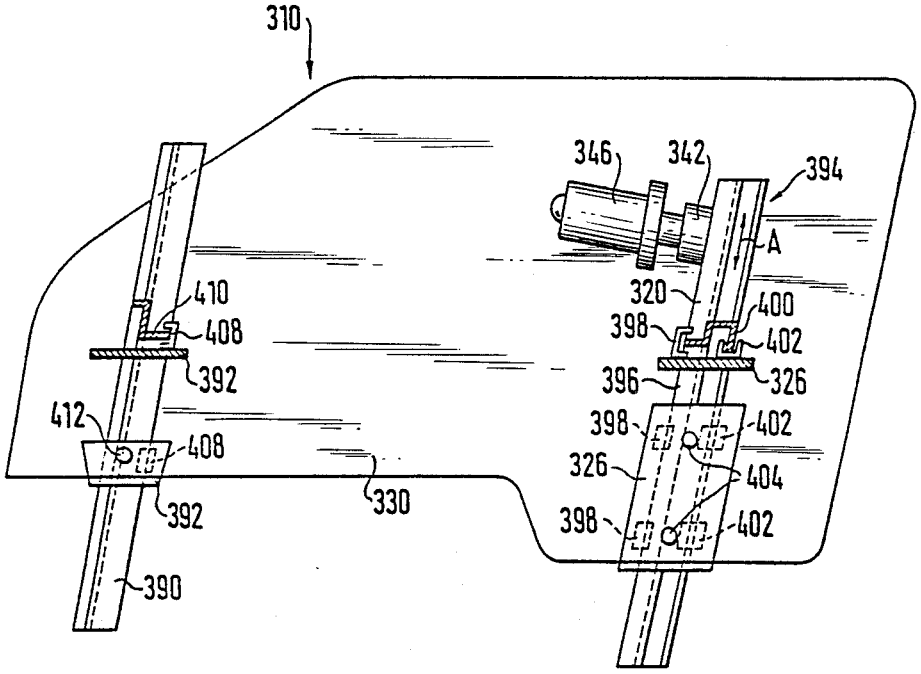

Fig. 1
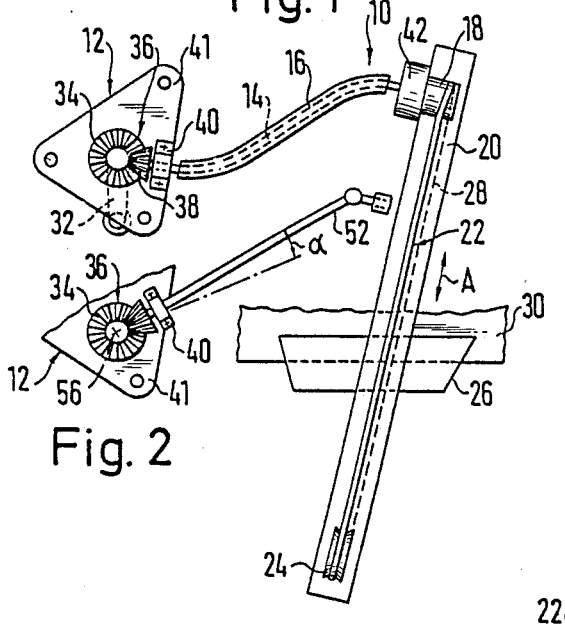
Fig. 2
Fig. 5
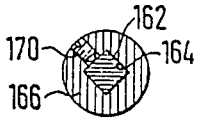
Fig. 6
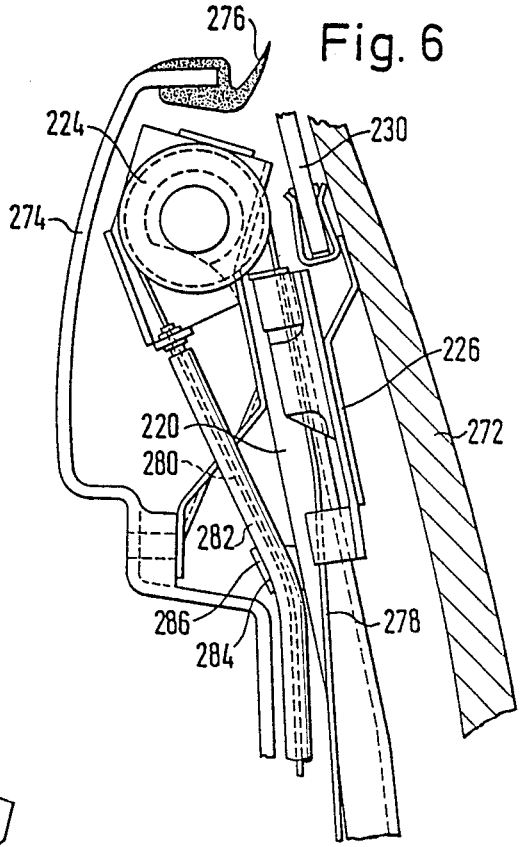
Fig. 3
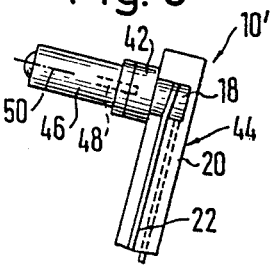
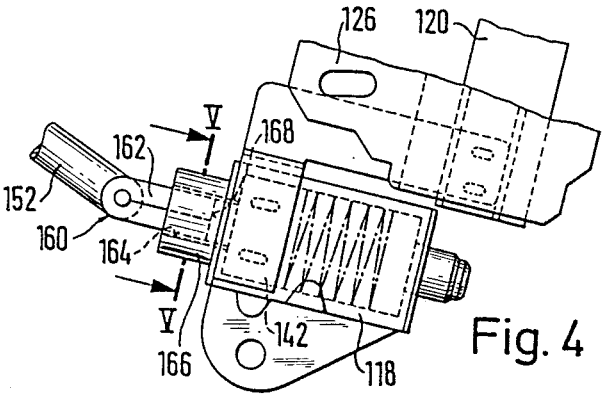
Fig. 4

SYSTEM FOR WINDOW OPERATION, ESPECIALLY IN A MOTOR VEHICLE

The invention is directed to a window actuation system, especially in a motor vehicle with a guide rail, a driver for a window glass panel supported at the guide rail so as to be movable in the longitudinal direction of the guide rail, a force transmittal member guided so as to be displaceable parallel to the guide rail longitudinal direction and engaging at the driver, a driver link for the force transmittal member attached at the guide rail and selectably a manual drive unit arranged so as to be remote from the guide rail, which is connected with the driving member through a torque transmission link, or a motorized drive unit force-coupled with the drive member.

In previous window regulators, a wrap around spring brake is provided in the manual drive unit (hand crank unit), which prevents an unintended lowering of the window glass pane, for instance caused by jarring when driving. In a manual window regulator with a torque transmittal link in the shape of a rigid shaft 21 between the manual drive unit 20 and the drive member in the form of a drive roller 11 for a toothed belt 17 known from DE-OS 30 00 050, there exists the phenomenon that if, as is generally usual, the hand crank unit is equipped with a wrap around spring brake, and with the hand crank drive stationary, all the elements in the force transmittal path between the wrap around spring brake and the window glass panel are subject to a cyclic load exerted by the window glass panel when driving because of jarring. The motion clearance which is unavoidable in the mass produced window regulator because of manufacturing conditions, the play existing between the elements in the force transmittal path (for instance Cardan joints at the end of the shaft), can in case of such alternating loads lead to undesirable noise generation and increased wear.

If a motor driven unit is used instead of a manual drive unit, then it completely replaces this manual drive unit together with the wrap around spring brake. For window glass panel immobilization an irreversible drive motor or a drive motor with an irreversible transmission is utilized, resulting in a correspondingly increased constructional cost.

The task of the invention consists in indicating a window lifting device of the previously mentioned type, which provides improved functioning in manual operation and which in motorized operation permits the use of a drive unit which can be fabricated in a more economical manner.

This task is solved by providing the drive member with a reverse brake, especially a wrap around spring brake, and by providing that the motorized drive unit can be fastened directly at the drive member or at the guide rail in the region of the drive member.

The force path, with the drive unit stationary, of the forces exerted by the window glass pane comprises now only the elements entrainment unit, force transmittal member, drive member and reverse brake and is thus correspondingly shortened. It is now also possible to use drive motors without irreversibility and without irreversible transmissions, so that for instance a direct coupling of the drive motor shaft and the drive member can be envisaged.

In order to facilitate assembly if a torque transmission member is used, it is proposed that the torque transmission member be made connectable with the drive member by means of a plug-in clutch with adjustable clearance in plug-in direction. Such a plug-in coupling, especially one formed by an inside polygon in the drive member and an outside polygon at the transmission member, enables easy compensation of more-or-less large installation position misalignments of the drive unit and drive member or guide rail. The respective adjustment can for instance be locked in by means of a stud screw or the like.

The drive unit can be built up in an extraordinarily simple manner because of the elimination of the wrap around spring brake, preferably with a bevel gear box unit with the torque transmission member being coupled to the output bevel gear.

In order to enable again the compensation of installation irregularities such as angular errors in the alignment of the shaft with respect to the drive unit, especially in case of a torque transmission member in the form of a rigid shaft, it is proposed to make the output bevel gear of the bevel gear box to be angularly adjustable with respect to the drive bevel gear. It is possible then to connect the rigid shaft directly with the output bevel gear with the possibility of compensating angular errors without being obliged to interpose a universal joint.

The invention is preferably used with cable window lifting devices or window lifting devices with a drive belt or toothed belt, wherein then the drive member is preferably a cable drum or a drive roller for the drive belt or the toothed belt.

Apart from the already mentioned rigid shaft, a flexible shaft is also preferred as a torque transmission member with the essential advantage that the installation position of the manual drive unit for the front and the rear door is independent of the respective construction of a window lifting structural unit comprising the guide rail.

In conventional cable driven window operating units, the cable loop lies in a plane essentially parallel to the window glass plate plane, so that correspondingly the loop axis lies at right angles to the window glass plate plane. If a drive member with a motor axis parallel to the window glass plate plane is used, which is usual because of space requirements, a direction reversal transmission between drive motor and drive member (cable drum) is therefore required. This reversing gear box can be eliminated in the invention since the output member is formed by a cable loop having a loop axis which is essentially parallel to the window glass plate plane and essentially perpendicular to the guide rail longitudinal direction (A) and which is conducted by means of two cable reversals at the guide rail ends, being one cable reversal at one guide rail end and by the drive member at the other guide rail end.

The cramped space conditions inside a vehicle door generally do not permit in such a cable loop orientation to conduct the cable section of the cable loop which is out of engagement with the entrainment member in a continuous straight line between the upper and the lower reversal. In order to avoid such cable reversals, for instance cable rollers in the region between the upper and the lower cable reversal, it is proposed that the cable segment of the cable loop which is out of engagement with the entrainment member run within a Bowden cable jacket.

The mentioned component comprises preferably the guide rail, the reverse brake, the force transmission member as well as the entrainment member. It however does not comprise, for instance, the manual drive unit with which it is connected in the installed state inside the respective vehicle door by means of a flexible or rigid shaft. The component is thus independent of the spatial assignment of hand crank and guide rail, which differs in case of the front and rear vehicle door. The component can thus be utilized without change in front as well as in the rear.

It is proposed for reducing the installation costs that the component be designed in such a way that it can be assembled by automatic manipulators.

The window operating system in the invention can also be designed in twin fashion, wherefore it is proposed that it comprise a second guide rail parallel to the first guide rail, at which second guide rail a second entrainment device is supported so as to be mobile in its longitudinal direction.

Herein it is preferred that one of the two entrainment members, preferably the first entrainment member, is supported at an assigned guide rail so as to be secured against tilting movements around a tilting axis essentially perpendicular to the window glass plate plane. Since the first guide rail retaining the drive member is to begin with designed to be correspondingly stable, it can serve for largely absorbing the above-named tilting forces. The second entrainment member then needs only to secure the glass plate against motion perpendicular to the window glass plate plane, for which purpose the correspondingly simply structured entrainment member preferably embraces only an edge strip of the second guide rail which is parallel to the window plate glass plane.

The invention is described in the following with the help of the drawing, using preferred embodiment examples.

It is shown in:

FIG. 1 a greatly simplified front view upon a window operating system according to the invention;

FIG. 2 a variant of the window operating system of FIG. 1 in the region of drive unit and torque transmittal member;

FIG. 3 a window operating system of FIG. 1 when using a motor drive unit instead of a manual drive unit;

FIG. 4 a detailed view upon an additional embodiment example of the window operating system in the invention in the region of the lower end of the guide rail with the there-located drive member;

FIG. 5 a section along the line V—V of FIG. 4;

FIG. 6 a detail view of an additional embodiment example of the window operating system of the invention in the region of the upper guide rail end, and FIG. 7 a front view similar to FIG. 1 upon a modified window operating system with two guide rails.

FIG. 1 depicts a window actuating or window lifting system 10 with a manual drive unit 12, which is connected with a cable drum 18 at the upper end of a guide rail 20 by a flexible shaft 14 conducted in a jacket 16. The cable drum 18 drives a cable loop 22 which is guided emanating from the cable drum 18 to a reversing roller 24 at the lower end of the guide rail 20 and back to the cable drum 18. An entrainment device or follower 26 is supported in the usual manner at the guide rail 20 so as to be displaceable back and forth in longitudinal direction A of the guide rail 20. The cable segment 28 of the cable lower loop 22 not visible in FIG. 1 is connected in a force transmitting manner with the follower 26 for instance by a cable nipple. The follower 26 engages on its part at a window glass plate 30. When operating a hand crank 32 of the drive unit 12 indicated in FIG. 1, the window glass plate 30 is accordingly raised or lowered.

The hand crank 32 is connected with a bevel gear wheel 34 so as to be nonrotatable with respect to same, the bevel gear wheel being part of a bevel gearing train 36. An output bevel gear 38 meshing with this bevel gear 34 is connected with the shaft 14 so as to be nonrotatable with respect thereto. A bearing block 40 serves for the rotary support of the output bevel gear 38 and for this purpose is fastened at a base plate 41 of the drive unit 12.

The other end of the shaft is inserted into a conventional wrap around spring brake 42 in the drive unit so as to be coupled with same in a nonrotational manner with respect thereto, the wrap around spring brake being coupled on the output side with the cable drum 18. The function of such a wrap around spring brake known as such is as follows:

When the shaft 14 is stationary, a brake (wrap around spring) engages with an output claw part connected with the cable drum 18 so as to be nonrotatable thereto, and thus prevents rotation of the cable drum 18 in one or the other direction. As soon as the shaft 14 however rotates in one or the other direction, the brake is immediately released through the entrainment of the wrap around spring, so that then a claw or dog portion being part of the drive and nonrotatably coupled with the shaft is able to drive the claw part on the output side.

According to FIG. 3 the guide rail unit 44 consisting of guide rail 20 with cable drum 18 and wrap around spring brake 42 can be used without change in a motor driven window actuator 10'. For this purpose a motor driven drive member instead of the flexible shaft 14, here in the shape of an electric motor 46, must be merely coupled to the wrap around spring brake 42 for instance by coupling or in particular inserting the motor shaft 48 indicated in FIG. 1 directly into the wrap around spring brake 42. The motor axis 50 thus coincides with the axis of the cable drum 18, so that a direction reversing gear train can be eliminated. A simple electric motor without irreversibilty can also be used in this case. The motor axis 50 lies parallel to the plane of the window glass plate 30, so that no space problems arise during installation. The loop axis of the cable loop 22 perpendicular to the loop plane lies parallel to the motor axis and thus perpendicularly to the longitudinal direction A of the guide rail 20 and parallel to the plane of the window glass plate.

As is intimated in FIG. 2, a rigid shaft 52 can be provided instead of a flexible shaft 14 as a torque transmittal member between the manual drive unit 12 and the wrap around spring brake 42. The bevel gear train 36 affords the possibility here to compensate angular errors (angle $\alpha$ in FIG. 2) due to installation of the shaft 52 with respect to the base plate 42 of the manual drive unit 12. For this purpose the bearing block 40 together with the output bevel gear 38 must merely be appropriately swiveled with respect to the axis 56 of the bevel gear 34 and must be fastened in the new position to the base plate 42. The output bevel gear 38 can be directly connected to the shaft 52.

In deviation from FIG. 1, the cable drum 18 can also be attached at the lower end of the guide rail, wherein then the reversing roller 24 is to be arranged correspondingly at the upper end of the guide rail. The possibility also exists to place the cable drum 18 between an upper and a lower cable reversing roller.

FIG. 4 depicts the details of a cable drum 118 at the lower end of a guide rail 120 indicated in cut-off fashion. An entrainment device 126 in its lowest end position is also depicted in FIG. 4 by way of a cut-off. The torque transmittal member in this case is formed similarly to FIG. 2 by a rigid shaft 152 which is connected with a head piece 162 by means of a universal joint 160. The head piece 162 in the shape of a polyhedral (for instance a square) is inserted into a correspondingly constructed inner polygonal opening 164. This opening 164 is located in a cylindrical portion 166 of the wrap around spring brake 142 according to FIG. 5. The part 166 is connected in a non-depicted manner with the drive claw part of the wrap around spring brake. As is intimated in FIG. 4, the free end 168 of the head piece 162 can be inserted to a greater or lesser extent into the recess 162 and can be fixed in the respective position for instance by means of a stud screw 170 indicated in FIG. 5. In this manner installation inaccuracies in the mutual alignment of the manual drive portion 12 and the lower guide rail end can be compensated.

FIG. 6 depicts more of the details of the upper end of a guide rail 220 in the installed state of the window actuator. One discerns an outer skin 272 and an inner skin 274 of a vehicle door as well as an inner sealing lip 276 at the upper end of the inner skin 274 for sealing the window glass plate 230. The entrainment member 226 is in its uppermost end position. The cable segment 278 engaging at the entrainment member is redirected by means of the upper cable reversing roller 224. The cable segment 282 following upon the cable roller 224 runs inside of a Bowden pull-cable jacket 282 downwards, whereby it can be readily conducted over a bend point 284 necessary in the vehicle door because of the cramped space conditions without having to use cable reversing rollers or the like. According to FIG. 6 this bending of the cable segment 280 is achieved by a simple lug 286 which projects from the guide rail 220 and embraces the Bowdel pull-cable jacket 282.

FIG. 7 is a simplified illustration of a window lifting device designated by 310 with a first guide rail 320 together with an entrainment member 326 as well as a second guide member 390 together with a second entrainment member 392. The first guide rail 320 constitutes a structural unit 394 together with a motorized drive member in the form of the electromotor 346 and the wrap around spring brake 342 (construction corresponding to FIG. 3) with inclusion of the cable drum, not depicted in FIG. 7, together with a closed cable loop. This structural unit 394 as such can be preassembled, especially with the use of automatic manipulators. The structural unit 394 can be utilized almost without any change for installation into a front as well as into a rear motor vehicle door. Then the first entrainment member 326 engaging at the window glass pane 330 must merely be slid onto the guide rail and said entrainment member must be coupled with the cable loop.

Only the first entrainment member 326 is driven. The second entrainment member 392, on the other hand, follows freely the movement of the first. Since the drive member (in this case the drive cable) runs over the first guide rail 320, it must be designed so as to be of adequate stability to begin with. In view of this no additional material is required in order to conduct the first entrainment member 326 in such a way at the first guide rail 320, that said entrainment member is secured against tilting motions around a tilting axis perpendicular to the plate of the window glass plate. It is intimated in the sectional drawing of the entrainment member 326 indicated above the first entrainment member 326, how this type of guidance can be achieved. In case of a guide rail cross section corresponding to a Z-U-profile, two slides 398 spaced from each other in longitudinal direction of the guide rail embrace an edge strip 396 of the guide rail 320 essentially parallel to the plane of the window glass plate which strip, for instance, is on the left hand side in FIG. 7. Two slides 402 spaced from each other in guide rail longitudinal direction embrace an edge strip 400 of the guide rail 320 essentially perpendicular to the plane of the window glass plate, which is on the right-hand side in FIG. 7.

Two attachment bolts spaced from each other in longitudinal direction of the guide rails provide the tilt-proof connection between the entrainment member 326 and the window glass plate 330, the heads 404 of which bolts are indicated in FIG. 7.

The second entrainment member 392 carried along by the window plate glass 330 serves merely for eliminating pivoting movements of the window plate glass 330 around the first guide rail 320 around a pivoting axis parallel to the guide rail longitudinal direction A of the first guide rail 320. It therefore suffices for the second entrainment member 392 to embrace with a slide piece 408 an edge strip 410 of the second guide rail 390 essentially parallel to the plane of the window glass plate. The second guide rail 390 has for instance a Z-shaped profile according to the sectional drawing indicated in FIG. 7.

One single attachment bolt suffices for fastening the window glass plate 330 to the second entrainment member 392, the head 412 of which attachment bolt is indicated in FIG. 7.

If necessary the electric motor 346 can be replaced by a manual drive member, possibly in the form shown in FIG. 2. If the manual drive unit is connected by a flexible shaft there results the circumstance that the unitized structural member 394 together with a manual drive unit can be used without change in the front as well the rear vehicle door, in spite of the fact that generally the spacing between the manual drive unit and the guide rail in the rear vehicle door differs from that in the front vehicle door.

I claimed:

1. A window actuation system, especially in a motor vehicle, comprising:

a first guide rail (20; 320);

a first entrainment member (26; 326) for a window glass plate (30; 330) supported at the guide rail (20; 320) so as to be movable in its longitudinal direction (A);

a force transmission member (22) engageable at the first entrainment member (26; 326) and guided so as to be mobile parallel to the longitudinal direction (A) of the first guide rail;

a drive member (18) for the force transmission member (22) attached to the first guide rail (20; 320); and drive means for driving the drive member (18), said drive means selectively including a manual drive unit (12) arranged remotely from the guide rail (20)

and connected with the drive member (18) by a torque transmission member (14; 52), and a motorized drive unit (46; 346) coupled with the drive member (18) so as to be able to transmit force, the drive member (18) having a wrap around spring brake (42; 342), and the motorized drive unit (46; 346) being directly attachable to one of the drive member (18) and the guide rail (20; 320) in the region of the drive member.

2. A window actuating system according to claim 1, wherein the torque transmission member (152) is connectable with the drive member (118) by means of a plug-in coupling with a clearance adjustment in a plug-in direction.

3. A window actuation system according to claim 1 wherein the torque transmission member (14; 52) is connectable with the manual drive unit (12) by means of a bevel gear train (36).

4. A window actuating system according to claim 3, wherein the bevel gear train includes an output bevel gear wheel (38) and a drive bevel gear (34), the output bevel gear wheel (38) being angularly adjustable with respect to the drive bevel gear (34).

5. A window actuating system according to claim 1, wherein the drive member is one of a cable drum (18) and a drive roller for one of a drive belt and a toothed belt.

6. A window actuating system according to claim 1, wherein the torque transmission member is a flexible shaft (14).

7. A window actuating system according to claim 1, wherein the drive member is formed by a cable loop (22) having a loop axis essentially parallel to the plane of the window glass plate and essentially perpendicular to the longitudinal direction (A) of the guide rail, the cable loop being conducted over one of two cable reversals at the guide rail ends and one cable reversal (24) at one guide rail end and the drive member (18) at the other guide rail end.

8. A window actuating system according to claim 7, and further comprising a Bowden cable pull jacket (282), the cable loop having a cable segment (280) which is out of engagement with the entrainment member (226) and runs in the Bowden cable pull jacket (282).

9. A window actuating system according to claim 1, wherein the guide rail (20; 320), the reverse brake (42; 342) and the force transmission member 22 form a structural unit (394).

10. A window actuating system according to claim 9, wherein the structural unit (394) is designed so as to be assemblable by means of an automatic manipulator.

11. A window actuating system according to claim 1, and further comprising a second guide rail (390) parallel to the first guide rail (320), and a second entrainment member (392) supported at the second guide rail so as to be mobile in the longitudinal direction of said second guide rail.

12. A window actuating system according to claim 11, wherein one of the two entrainment members is supported at an assigned guide rail (320) so as to be secured against tilting movements around a tilting axis essentially perpendicular to the plane of the window glass plate.

13. A window actuating system according to claim 12, wherein the one of the two entrainment members is the first entrainment member (326).

14. A window actuating system according to claim 12, wherein the other of the entrainment members (392) is designed around a pivot axis parallel to the longitudinal direction (A) of the assigned guide rail (320) so as to prevent swiveling movements of the window glass plate (330) around said assigned guide rail (320) which guides the one entrainment member.

15. A window actuating system according to claim 14, wherein the other entrainment member (392) is arranged so as to solely embrace an edge strip (410) essentially parallel to the plane of the window glass plate, said edge strip being part of the guide rail (390) guiding said other entrainment member (392).

16. A window actuating system according to claim 1, wherein the torque transmission member is a rigid shaft (152) provided with a universal joint (160).

* * * * *